US012611025B2

(12) United States Patent
Evain et al.

(10) Patent No.: US 12,611,025 B2
(45) Date of Patent: Apr. 28, 2026

(54) APPLICATOR FOR APPLYING MAKEUP TO HUMAN KERATIN FIBRES, IN PARTICULAR THE EYEBROWS

(71) Applicant: L'OREAL, Paris (FR)

(72) Inventors: Gabriel Evain, Clichy (FR); Marcel Sanchez, Clichy (FR)

(73) Assignee: L'OREAL, Paris (FR)

( * ) Notice: Subject to any disclaimer, the term of this patent is extended or adjusted under 35 U.S.C. 154(b) by 159 days.

(21) Appl. No.: 17/780,376

(22) PCT Filed: Nov. 27, 2020

(86) PCT No.: PCT/EP2020/083709
§ 371 (c)(1),
(2) Date: May 26, 2022

(87) PCT Pub. No.: WO2021/105411
PCT Pub. Date: Jun. 3, 2021

(65) Prior Publication Data

US 2023/0014623 A1 Jan. 19, 2023

(30) Foreign Application Priority Data

Nov. 28, 2019 (FR) ..... 19 13382

(51) Int. Cl.
*A45D 40/26* (2006.01)
*A46B 9/02* (2006.01)

(52) U.S. Cl.
CPC ..... *A45D 40/265* (2013.01); *A46B 9/021* (2013.01)

(58) Field of Classification Search
CPC .. A45D 40/265; A45D 40/261; A45D 40/262; A45D 2200/10; A46B 9/021
See application file for complete search history.

(56) References Cited

U.S. PATENT DOCUMENTS 9,532,642 B2 * 1/2017 Zech ..... A46B 3/005
2002/0005209 A1 * 1/2002 Gueret ..... A45D 40/267 132/218

(Continued)

FOREIGN PATENT DOCUMENTS

EP 1 726 235 A2 11/2006
FR 2 810 860 A1 1/2002

(Continued)

OTHER PUBLICATIONS

International Search Report issued Feb. 9, 2021 in PCT/EP2020/083709 filed on Nov. 27, 2020, 3 pages.

(Continued)

*Primary Examiner* — Rachel R Steitz
(74) *Attorney, Agent, or Firm* — Oblon, McClelland, Maier & Neustadt, L.L.P.

(57) ABSTRACT

Applicator for applying makeup to and/or caring for human keratin fibres, having a stem that extends along a longitudinal axis and is connected at one end to a gripping member and at the other end to an applicator member, the latter extending along a longitudinal axis that is not parallel to the longitudinal axis of the stem, and having a hollow support of elongate overall shape including two opposite longitudinal arms that define an opening between one another and meet at the distal end of the applicator member, and at least one bridge of material that extends transversely to the longitudinal axis of the applicator member and is connected to said arms of the support, protruding from the opening on the opposite side from the recess of the elbow formed by the applicator member and the stem.

26 Claims, 5 Drawing Sheets

(56) References Cited

U.S. PATENT DOCUMENTS

| | | | |
|---|---|---|---|
| 2005/0217691 | A1 | 10/2005 | Petit |
| 2010/0294297 | A1 | 11/2010 | Gueret |

FOREIGN PATENT DOCUMENTS

| | | | |
|---|---|---|---|
| FR | 2 895 887 | A1 | 7/2007 |
| FR | 2 909 532 | A1 | 6/2008 |
| FR | 2 933 854 | A1 | 1/2010 |
| FR | 2 951 359 | A1 | 4/2011 |
| FR | 2 971 923 | A1 | 8/2012 |
| FR | 2 980 677 | A1 | 4/2013 |
| WO | 2013/153528 | † | 10/2013 |

OTHER PUBLICATIONS

French Preliminary Search Report issued Jul. 9, 2020 in French Application 19 13382 filed on Nov. 28, 2019, 3 pages (with English Translation of Categories of Cited Documents).

* cited by examiner
† cited by third party

APPLICATOR FOR APPLYING MAKEUP TO HUMAN KERATIN FIBRES, IN PARTICULAR THE EYEBROWS

TECHNICAL FIELD

The present invention relates to the making up of and/or caring for human keratin fibres, in particular the eyebrows and/or hairs of the beard and/or roots of the hair, which may have an organization of the fibres in tufts, as opposed to the eyelashes of the eyelid, which are organized as a more or less straight row.

PRIOR ART

Numerous packaging and application devices have been proposed for applying makeup to the eyebrows.

Makeup is not applied to the eyebrows in the same way as it is applied to the eyelashes of the eyelid. The making up of the eyebrows usually aims to give the impression of a greater density of hairs or to correct the contour of the eyebrows, whereas the making up of the eyelashes of the eyelid seeks rather to lengthen the eyelashes and make them thicker and more visible.

Numerous techniques of applying makeup to the eyebrows usually involve depositing product simultaneously on the hairs of the eyebrows and on the underlying skin, in order to visually fill to a certain extent the spaces between the hairs and/or the areas of the eyebrows that have a lower density of hairs than the rest of the eyebrows.

A usual way of making up the eyebrows involves the use of a pencil or a felt tip, making it possible to draw on the skin lines that imitate the hairs of the eyebrows, so as to give the illusion of a greater density of hairs and/or to outline the contour of the eyebrows so as to correct it. The use of the pencil or felt tip is often preceded or followed by the combing of the eyebrows with the aid of a brush or a comb that is not loaded with product. This technique is relatively time-consuming and requires a great deal of attention on the part of the user.

Another known technique combines the use of a fine brush with a bevelled tip to trace the contour of the eyebrows and load the hairs of the eyebrows with product, and of a brush or a comb to comb the eyebrows.

Sometimes, generally after the eyebrows have been made up, a composition such as a fixing gel is applied thereto with the aid of a brush with a twisted core of suitable shape or of a foam end piece.

Some people, in order to make up their eyebrows, use mascara intended to be applied to the eyelashes of the eyelid, by picking up the product, from the mascara brush that has just been withdrawn from its container, with the aid of a fine brush with a bevelled tip, which is then used to make up the hairs of the eyebrows. Next, a brush without any product is generally used to comb the eyebrows.

Thus, making up the eyebrows frequently involves multiple applicators, with hand actions that are not always quick or easy.

Furthermore, numerous mascara applicators are described in the publications FR 2 810 860, FR 2 909 532, U.S. Pat. No. 9,532,642, US 2010/0294297, FR 2 951 359, FR 2 980 677 or FR 2 933 854. Although said documents mention the possibility of applying the composition to the eyebrows, in practice the applicators described therein are more specifically designed for applying makeup to the eyelashes of the eyelid.

DISCLOSURE OF THE INVENTION

Therefore, there is a need to further improve applicators intended for applying makeup to the eyebrows, in order in particular to quickly and easily obtain a makeup result that is satisfactory, both in terms of the amount of composition applied and in terms of the combing of the eyebrows and the definition of the line they form.

SUMMARY OF THE INVENTION

The invention aims to meet this need and its subject, according to a first of its aspects, is an applicator for applying makeup to and/or caring for human keratin fibres, preferably other than the eyelashes of the eyelids, in particular for applying makeup to and/or caring for the eyebrows and/or hairs of the beard and/or the roots of the hair, having a stem that extends along a longitudinal axis and is connected at one end to a gripping member and at the other end to an applicator member, the latter extending along a longitudinal axis that is not parallel to the longitudinal axis of the stem and forms an elbow therewith, and having a hollow support of elongate overall shape comprising:

- two opposite longitudinal arms that define an opening between one another and meet at the distal end of the applicator member, the support having an overall tapered shape in the direction of said distal end when viewed in a direction generally perpendicular to the opening, and
- at least one bridge of material that extends transversely to the longitudinal axis of the applicator member and is connected to said arms of the support, protruding from the opening on the opposite side from the recess of the elbow formed by the applicator member and the stem.

The support preferably has a plurality of bridges of material, in particular between three and ten bridges of material.

The applicator according to the invention makes it possible to obtain precise makeup results on the eyebrows or other keratin fibres arranged in tufts, such as the hairs of the beard or head hair for application to the roots thereof, while maintaining relatively simple hand actions.

This is because the hollow support makes it possible to create an optimal consistent reserve of composition between the bridges of material and the arms of the support. The tapered shape of the applicator member makes it possible to have a narrower distal part and confers precision on the end of the applicator during makeup application, in particular for drawing the outer tip of the eyebrows, which is a region that usually has smaller hairs, without being impaired by the bridges of material.

Moreover, such a shape is suited to the passage of the applicator through a wiping member of a packaging device having the applicator according to the invention, making it possible to obtain an optimal amount of composition on the applicator member while avoiding leaks of composition, and making it easier to pass through the wiping member when the applicator is put back in place on the container of said device.

The inclination of the applicator member relative to the stem contributes to the ergonomics of the applicator, and allows the user to easily and precisely reach the whole eyebrow.

The applicator member forms an elbow with the stem and is off-centre, the distal end of the applicator member not lying on the longitudinal axis of the stem.

The fact that the bridges of material protrude on the opposite side from the recess of the elbow formed by the applicator member and the stem makes it possible to have a less wiped region of the applicator member at the proximal end thereof, and a more wiped region at the distal end thereof, enhancing the precision of makeup application.

The user can deposit the composition on the keratin fibres to be made up with it being possible to apply pressure with the applicator on the areas of the body bearing these fibres, such as the eyebrow arch in order to make up the eyebrows, in order to deposit the composition and/or style the fibres. In the process, the applicator can deposit the composition on the underlying skin, and thus fill any areas with a low density of keratin fibres. The bridges of material protruding on the opposite side from the recess of the elbow formed by the applicator member and the stem advantageously have a degree of flexibility, caused in particular by their shape and/or the material of which they are constituted, making it possible to improve comfort of application when the applicator member is brought into contact with, and in particular pressed against, the areas of the body bearing the fibres, such as the eyebrow arch in order to make up the eyebrows. Specifically, during use, the bridges of material protruding on the opposite side from the recess of the elbow formed by the applicator member and the stem can advantageously bend, in particular at the points where they meet the arms of the support of the applicator member, in particular when the applicator member is pressed against the areas of the body bearing the fibres and is moved over the latter.

Preferably, the bridges of material are arched, extending along a curved longitudinal axis. Such an arched shape makes it advantageously possible to confer flexibility on the bridges of material and thus improve comfort of using the applicator member. These arched bridges of material may have an, in particular convex, outer face that protrudes on the opposite side from the recess of the elbow formed by the applicator member and the stem, when the applicator is viewed from the side. The applicator member thus advantageously has a domed front face, with bridges of material in the form of arches for gentle and precise combing and effective separation of the eyebrows, making it possible to define a large reserve of composition within the applicator. Moreover, such an applicator is easy to manufacture by moulding.

The applicator member may further have at least one straight bridge of material, better still a plurality of straight bridges of material. The applicator member may thus have an alternation of arched bridges of material and straight bridges of material along its longitudinal axis. This configuration, which creates a flat face on the opposite side from the domed face, makes it possible to create reservoirs of material between the different bridges, along the entire length of the applicator member.

In a variant, the applicator member further has arched bridges of material protruding on the side of the recess of the elbow formed by the applicator member and the stem, when the applicator is viewed from the side, the different arched bridges of material thus extending alternately above and below the opening defined by the support.

Such an alternation of different types of arched and straight bridges of material makes it possible in particular to define a loading face, on the side of the straight bridges of material and in particular in the vicinity of the distal end of the applicator member, for preliminary makeup application, and a covering face, on the side of the arched bridges of material, for finishing.

Preferably, each bridge of material connects the two opposite longitudinal arms of the support together.

The expression "the bridge of material extends transversely to the longitudinal axis of the applicator member" should be understood as meaning that the bridge of material extends obliquely or perpendicularly with respect to the longitudinal axis of the applicator member, the axis along which the bridge of material extends not being parallel to the longitudinal axis of the applicator member.

At least one bridge of material, better still all the bridges of material, extend(s) preferably along an oblique axis with respect to the longitudinal axis of the applicator member. This makes it possible to retain more composition within the applicator after it passes through the wiping member. Furthermore, by virtue of these provisions, the introduction and withdrawal of the applicator member through the wiping member are carried out more gently than if the bridges of material were to extend along a perpendicular axis with respect to the longitudinal axis of the applicator member, the bridges of material deforming the wiping lip of the wiping member more gradually when the applicator member passes through the wiping member. In a variant, at least one bridge of material, better still all the bridges of material, extend(s) along a perpendicular axis with respect to the longitudinal axis of the applicator member.

The axis along which a bridge of material extends may form, with the longitudinal axis of the applicator member, an angle of between 10° and 80°, better still between 30° and 60°.

Preferably, the bridges of material extend along mutually parallel axes.

Preferably, flocking is present on at least a portion of the surface of at least one bridge of material, better still on at least a portion of the surface of each bridge of material, even better still on the entire surface of each bridge of material.

Flocking may further be present on the two opposite arms of the support, flocking further being present in particular on the front region of the support at the opposite end from the stem where the two opposite arms of the support meet. The flocking that is thus present may in particular be used to apply the composition to the skin underlying the eyebrows. The bridges of material, in particular the arched bridges of material, make it possible for their part to comb the hairs of the eyebrows, while loading them with product. The presence of the flocking confers flexibility on the bridges of material, making it possible to obtain an applicator that is gentle, precise, and pleasant to use for application.

The length of the flocking may be between 0.9 mm and 2 mm, being in particular equal to 1.5 mm. The thickness of the flocking may be between 5 dtex and 8 dtex, being in particular equal to 6.7 dtex.

The bridges of material advantageously are devoid of spikes.

The support of the applicator member advantageously is devoid of spikes.

The bridges of material preferably have a cross section of circular shape. When flocking is present, the latter can thus be deposited uniformly around the periphery of the bridges of material. A section of circular shape makes it possible to avoid the presence of sharp edges so as not to damage the eyebrows.

In a variant, the bridges of material have a cross section of polygonal shape, in particular of square or rectangular shape. When the applicator member is devoid of flocking, this makes it possible to obtain edges for combing the eyebrows on the bridges of material. When flocking is present, these combing edges are further present, since less flocking is deposited on said edges, in a manner inherent to the flocking process.

The spacing between two consecutive bridges of material, measured on one of the arms of the support at the point where the bridges of material meet, perpendicularly to the axes of the bridges of material, may be between 0.5 mm and 2 mm, better still between 0.5 mm and 1 mm.

The spacing between two bridges of material protruding on the same side of the support, measured on one of the arms of the support at the point where the bridges of material meet, perpendicularly to the axes of the bridges of material, may be between 0.6 mm and 2 mm, better still between 0.8 mm and 1 mm. This spacing range is very particularly suitable for making up the eyebrows.

Each bridge of material advantageously protrudes from the support to a maximum height of between 2 mm and 5 mm, better still between 3 mm and 4 mm. This maximum height corresponds to the distance between the base of the bridge of material at the point at which it is connected to an arm of the support and the orthogonal projection of a point of the bridge of material situated at the centre thereof on a plane that passes through said base and is perpendicular to the longitudinal axis of the applicator member.

The different characteristics of the bridges of material, in particular their height, their number and their spacing, can be chosen depending on the desired makeup results.

The thickness of each bridge of material, measured perpendicularly to the axis along which it extends, may be between 0.5 mm and 2 mm, better still between 0.5 mm and 1 mm.

The support advantageously has the overall shape of a frame, having a rear region that is oriented transversely to the longitudinal axis of the applicator member and is connected to the stem, and two opposite lateral arms that meet in a front region of the support at the opposite end from the stem and advantageously form a tip. The support defines a planar opening that it surrounds entirely.

The arms of the support may extend in a plane comprising the longitudinal axis of the applicator member.

The length of the front region of the support, measured along the longitudinal axis of the applicator member between its distal end and the start of the opening on the distal side, may be between 1 mm and 5 mm, better still between 1 mm and 2 mm.

The arms of the support preferably have a variable thickness, in particular one that decreases towards the distal end of the applicator member. In a variant, the arms of the support have a constant thickness. The thickness of the arms of the support, measured perpendicularly to the plane in which they extend, may be between 0.6 mm and 2 mm, better still between 0.8 mm and 1 mm.

The applicator member is advantageously asymmetric with respect to a plane intersecting the applicator member half-way through the thickness thereof. Thus, the properties of the applicator are different for the two faces, and the user can use one or the other of the faces depending on the desired effect or the application zone or the makeup step.

The transverse dimension of the support advantageously increases and then decreases in the direction of the distal end of the applicator member. The support thus advantageously has, when viewed from above, a droplet shape, the narrowest end of this droplet shape being provided at the distal end of the applicator member.

The support may have, when seen from above, a shape other than a droplet shape, in particular a triangle or rhombus shape, inter alia.

The greatest transverse dimension of the support, measured perpendicularly to the longitudinal axis of the applicator member, may be between 4 mm and 8 mm, better still between 5 mm and 6 mm.

The axis along which the applicator member extends may form, with the longitudinal axis of the stem, an angle of between 2° and 30°, better still between 5° and 10°.

The visible length of the support may be between 8 mm and 30 mm, better still between 10 mm and 20 mm, being for example around 15 mm.

The diameter of the stem may be between 3 mm and 7 mm, being in particular equal to 4.5 mm.

The applicator member is advantageously injection moulded, in particular from a thermoplastic material, for example a thermoplastic elastomer. The applicator member may have an end piece for fastening in the stem, said end piece being in particular moulded with the support and forming an elbow with the latter. The fastening end piece may be rounded but have a flat face on the side of the elbow formed with the support, the stem having the same shape. The flat face of the stem allows the applicator to be held comfortably and effectively in the hand during the application of makeup.

The keratin fibres are advantageously other than the eyelashes of the eyelid. Preferably, the keratin fibres are the eyebrows.

Packaging and Application Device

A further subject of the invention, according to another of its aspects, is a packaging and application device having an applicator according to the invention and a container containing a composition for making up and/or caring for human keratin fibres, in particular the eyebrows and/or hairs of the beard and/or roots of the hair, to be applied with the aid of said applicator.

The container advantageously has a wiping member for wiping the applicator member as it leaves the container. The diameter of the wiping lip defined by the wiping member may be between 2 mm and 5 mm, being in particular equal to 3.5 mm.

The ratio between the diameter of the wiping lip and the greatest transverse dimension of the support may be between 0.25 and 0.75, better still between 0.5 and 0.65.

The composition is preferably chosen from a care product for the eyebrows and a makeup product to be applied to the eyebrows, and may have a liquid to pasty consistency.

The composition may contain pigments, in particular blacks, for example iron oxides.

The features mentioned above for the applicator apply to the device, and vice versa.

Makeup Method

A further subject of the invention, according to another of its aspects, is a method for making up and/or caring for human keratin fibres, in particular a method for making up and/or caring for the eyebrows and/or hairs of the beard and/or roots of the hair, this method involving the application of a composition, in particular simultaneously to said fibres and to the underlying skin, by means of the applicator according to the invention.

The features mentioned above for the applicator and the device apply to the makeup method, and vice versa.

BRIEF DESCRIPTION OF THE DRAWINGS

The invention may be understood better from reading the following detailed description of a non-limiting implementation example thereof and from studying the appended drawing, in which.

DETAILED DESCRIPTION

Figure 1:
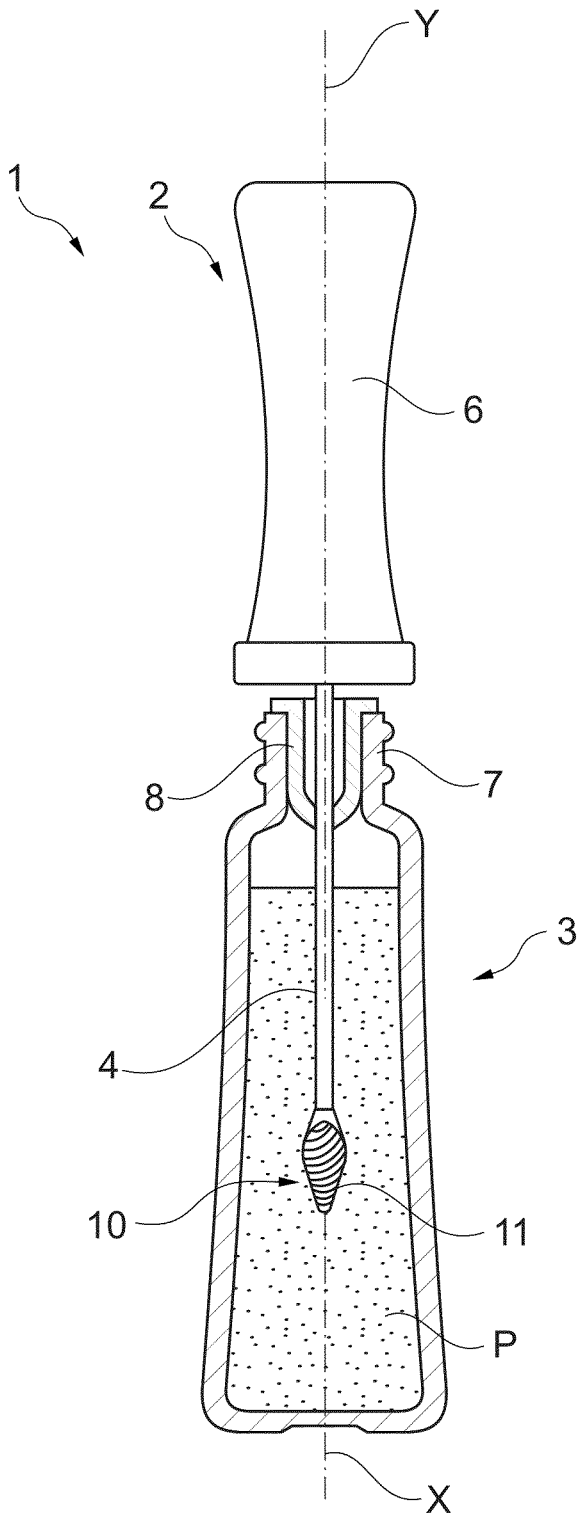
FIG. 1 schematically shows a packaging and application device according to the invention.

FIG. 1 schematically illustrates a packaging and application device 1 according to one implementation example of the invention.

The device 1 has an applicator 2 according to the invention and a container 3 containing a composition P to be applied to the eyebrows.

The applicator 2 has an applicator member 10 situated at the end of a stem 4 that is connected at the other end to a gripping member 6, which further constitutes a member for closing the container 3.

The container 3 has a threaded neck 7 and a wiping member 8 for wiping the applicator member 10 as it leaves the container.

Figure 3:
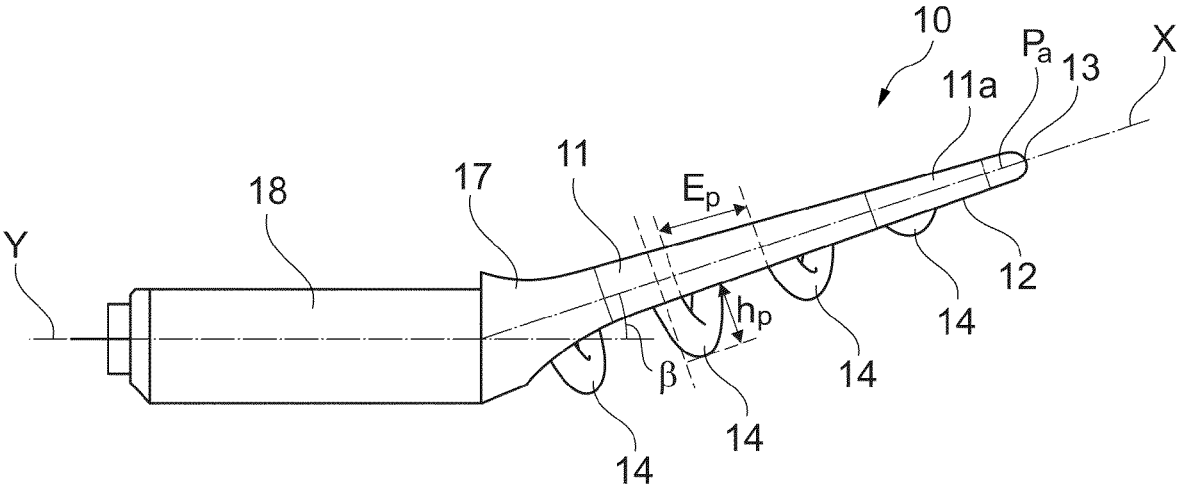
FIG. 3 is a side view of the applicator member in FIG. 2.

Referring in particular to FIG. 3, it can be seen that the applicator member 10 extends along a longitudinal axis X that is not parallel to the longitudinal axis Y of the stem 4.

The applicator member 10 has a hollow support 11 having the overall shape of an elongate frame, comprising a rear region 11*c* that is oriented transversely to the longitudinal axis X of the applicator member 10 and is connected to the stem 4, and two opposite longitudinal arms 11*a*, 11*b* that define a planar opening 12 between one another and meet at the distal end 13 of the applicator member 10 in a front region 11*d* at the opposite end from the stem 4, advantageously forming a tip. The support 11 thus has an overall tapered shape in the direction of said distal end 13 when viewed in a direction generally perpendicular to the opening 12, as can be seen in particular in FIG. 2. The opposite arms 11*a*, 11*b* extend preferably in a plane $P_a$ comprising the longitudinal axis X of the applicator member 10.

The length $l_a$ of the front region 11*d* of the support 11, measured along the longitudinal axis X of the applicator member 10 between its distal end 13 and the start of the opening 12 on the distal side, may be between 1 mm and 5 mm.

The support 11 further comprises a plurality of bridges of material 14, which advantageously are devoid of spikes, extend transversely to the longitudinal axis X of the applicator member 10 and meet at said arms 11*a*, 11*b*. The bridges of material 14 protrude from the opening 12 on the opposite side from the recess 17 of the elbow formed by the applicator member 10 and the stem 4. In the example in question, the bridges of material 14 are arched, extending along a curved longitudinal axis Z. The applicator member 10 further has straight bridges of material 15 that extend along a straight longitudinal axis T. The applicator member 10 thus has, in this example, an alternation of arched bridges of material 14 and straight bridges of material 15 along its longitudinal axis X.

Figure 4:
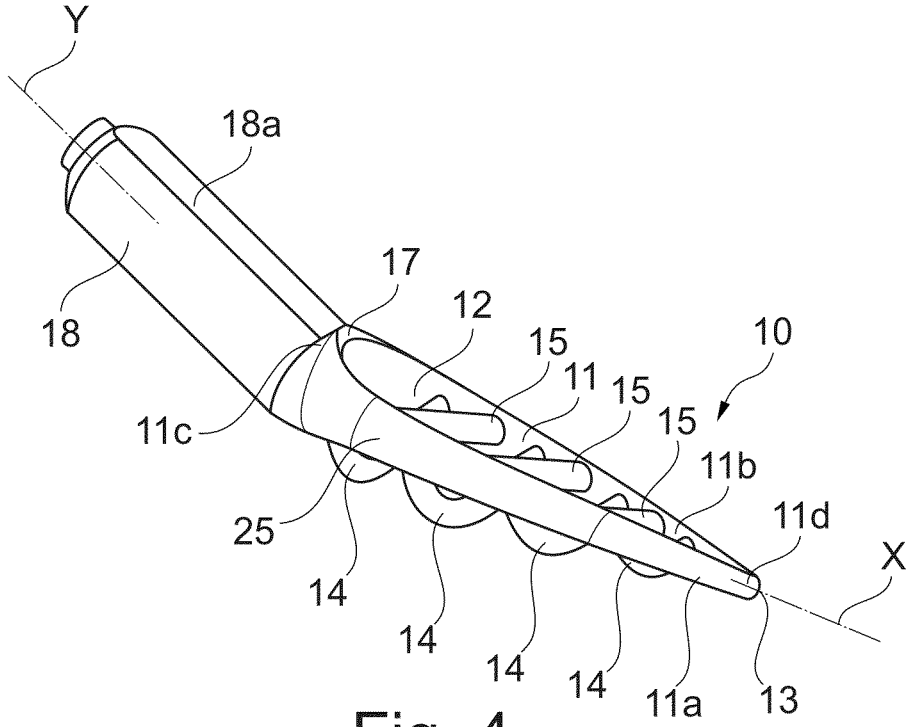
FIG. 4 is a perspective view of the applicator member in FIG. 2.

In the example described, the support 11 is continued on the proximal side by an end piece 18 for fastening in the stem 4, the end piece 18 preferably being moulded with the support 11 and forming an elbow with the latter, as can be seen in particular in FIG. 3. In the example described, the fastening end piece 18 is rounded but has a flat face 18*a* on the side of the elbow formed with the support 11, as shown in FIG. 4.

Preferably, and in the example in question, all the bridges of material 14, 15 are mutually parallel and extend along an oblique axis with respect to the longitudinal axis X of the applicator member 10. The axis T, Z along which a bridge of material 15, 14 extends may form, with the longitudinal axis X of the applicator member 10, an angle $\alpha$ of between 10° and 80°, better still between 30° and 60°.

Figure 5:
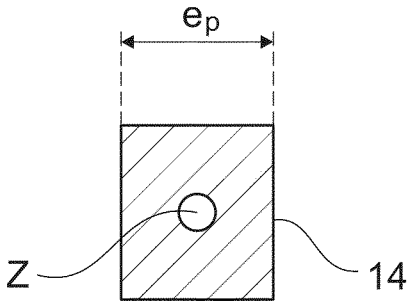
FIG. 5 shows a cross section through a bridge of material according to an embodiment variant of the invention, shown in section.

In the example in FIGS. 1 to 4, the bridges of material 14, 15 have a cross section of circular shape. In the variant shown in FIG. 5, the bridges of material 14, 15 have a cross section of square shape.

In the examples in question, the spacing $E_c$ between two consecutive bridges of material 14, 15 or 16 is between 0.5 mm and 2 mm, better still between 0.5 mm and 1 mm. Furthermore, the spacing $E_p$ between two bridges of material 14 protruding on the same side of the support 11 is between 0.6 mm and 2 mm, better still between 0.8 mm and 1 mm.

The bridges of material 14, 15, 16 advantageously protrude from the support 11 to a maximum height $h_p$ of between 2 mm and 5 mm, better still between 3 mm and 4 mm.

The thickness $e_p$ of the bridges of material 14, 15, 16 may be between 0.5 mm and 2 mm, better still between 0.5 mm and 1 mm.

In the example described, the arms 11*a*, 11*b* of the support 11 have a variable thickness, decreasing towards the distal end 13 of the applicator member 10.

Figure 6:
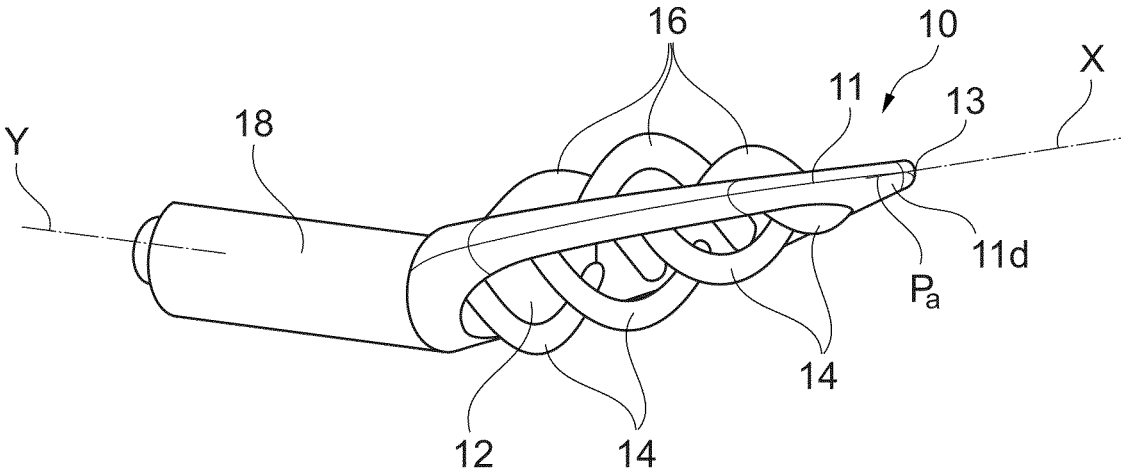
FIG. 6 is a perspective view of a variant applicator member produced according to the invention, as moulded, before it is optionally flocked and is mounted on the stem of the applicator.

As can be seen in particular in FIGS. 3 and 6, the applicator member 10 is advantageously asymmetric with respect to a plane $P_a$ intersecting the applicator member 10 half-way through the thickness thereof.

The longitudinal axis X of the applicator member 10 may form, with the longitudinal axis Y of the stem 4, an angle $\beta$ of between 2° and 30°, better still between 5° and 10°.

The visible length L of the support 11 may be between 8 mm and 30 mm, better still between 10 mm and 20 mm, being for example around 15 mm.

Figure 2:
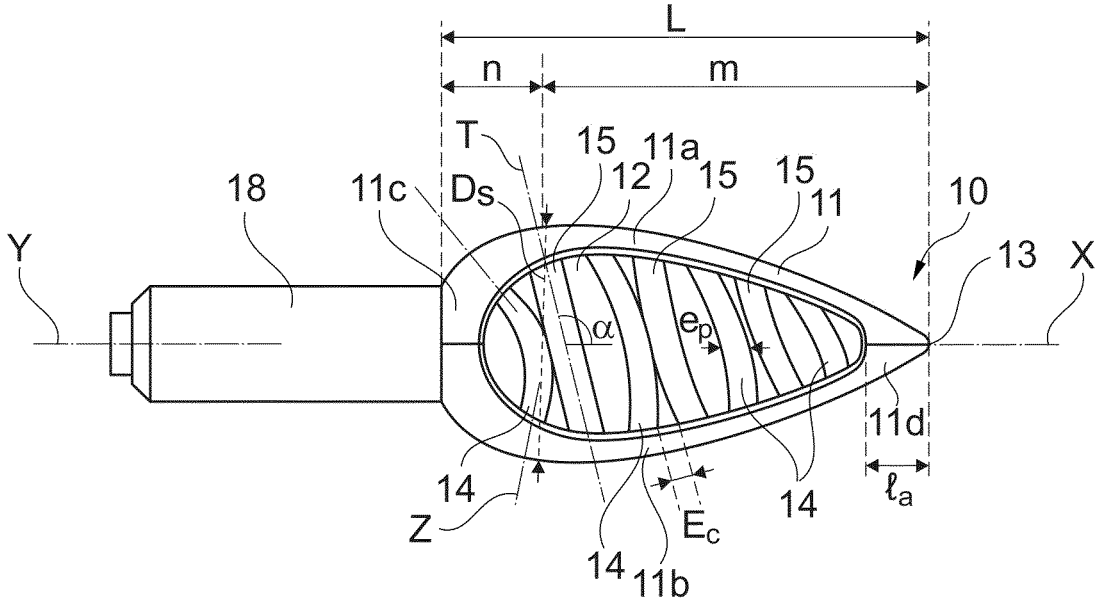
FIG. 2 shows a top view of the applicator member, as moulded, before it is optionally flocked and is mounted on the stem of the applicator.

As can be seen in FIG. 2 in particular, the support 11 has, in top view, a droplet shape, and its transverse dimension $D_s$ decreases in the direction of the distal end 13 over a distance m that is greater than the distance n over which the transverse dimension $D_s$ increases from the rear to the front.

Where the transverse dimension $D_s$ of the support 11 is at a maximum, said dimension is for example between 4 mm and 8 mm. The distance n is for example about 2 mm and the distance m for example about 12 mm.

In cross section, the sides 25 of the support 11 are slightly curved and convex towards the outside, as can be seen for example in FIG. 4.

In a variant shown in FIG. 6, the applicator member 10 has, besides the arched bridges of material 14 protruding on the opposite side from the recess 17 of the elbow formed by the applicator member 10 and the stem 4, arched brides of material 16 protruding on the side of the recess 17 of said elbow, the different arched bridges of material 14 and 16 extending alternately above and below the opening 12 defined by the support 11.

Figure 7:
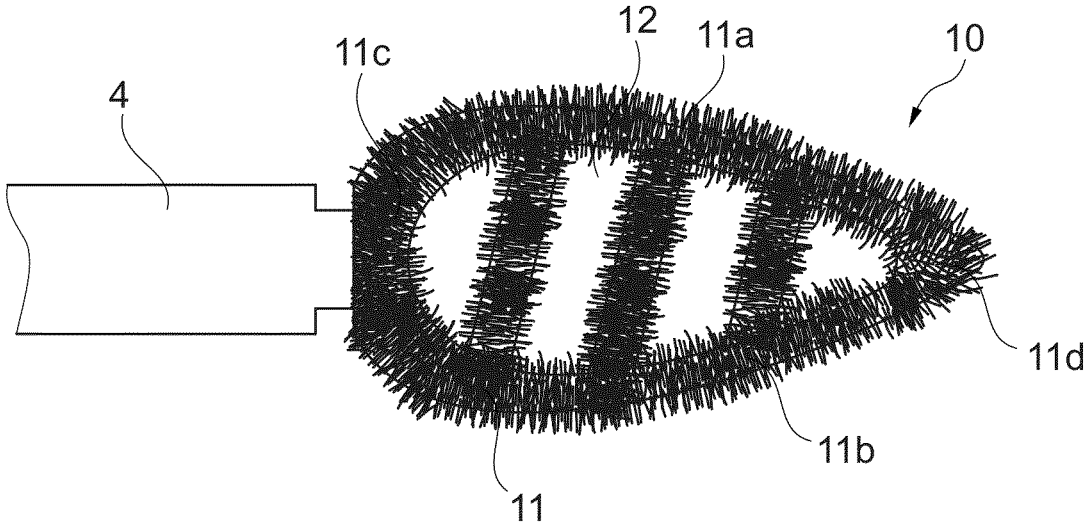
FIG. 7 shows a top view of the applicator member in FIG. 6 after flocking.
Figure 8:
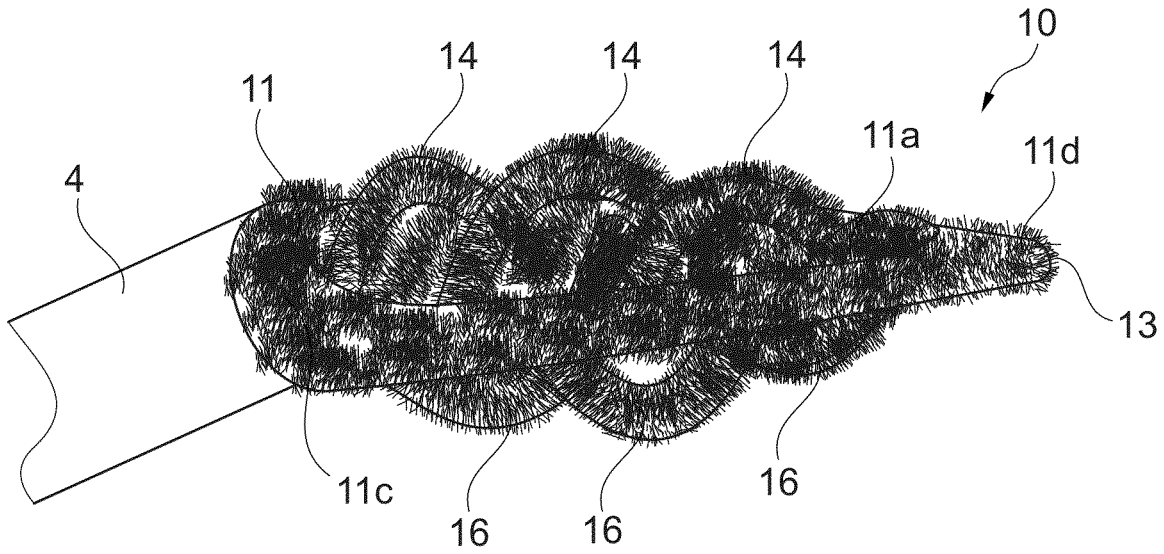
FIG. 8 shows a side view of the applicator member in FIG. 6 after flocking.

In the example shown in FIGS. 7 and 8, flocking is present on the entire surface of each bridge of material 14 and 16 and on the two opposite arms 11*a*, 11*b* of the support 11, and on the front region 11*d* of the latter.

The length of the flocking may be between 0.9 mm and 2 mm, and the thickness thereof between 5 dtex and 8 dtex.

The composition P is suitable for making up the eyebrows, and may have a liquid to pasty consistency.

In order to manufacture the applicator 2, the applicator member 10 can be injection moulded, for example from a thermoplastic material, in particular a thermoplastic elastomer. Next, the applicator member 10 can be dipped at its end in an adhesive and then covered electrostatically with flocking.

In order to use the device 1, the user withdraws the applicator 2 from the container 3. The user can use the optimal consistent reserve of composition P created between the bridges of material 14, 15, 16 and the arms 11*a*, 11*b* of the support 11 to make up their eyebrows, the bridges of material 14 and/or 16 in the form of arches allowing gentle and precise combing and effective separation of the eyebrows. The user can then use the tapered and straight front region 11*d* of the applicator member 10 to precisely draw the outer tip of the eyebrows.

The hand actions remain simple, and the user does not have to change accessory while applying makeup. The user can make use of one side of the support 11 and then the other to make up one and the same eyebrow. The user dips the applicator member 10 back in the container 3 as many times as necessary.

The invention is not limited to the examples that have just been described.

For example, the disposition of the bridges of material may be modified, and it is possible in particular to modify the number, shape and/or orientation thereof.

The invention claimed is:

1. An applicator for applying makeup to and/or caring for human keratin fibres, having a stem that extends along a longitudinal axis and is connected at one end to a gripping member and at the other end to an applicator member, the latter extending along a longitudinal axis that is not parallel to the longitudinal axis of the stem and forming an elbow therewith, and having a distal end and a hollow support of elongate overall shape comprising:

two opposite longitudinal arms that define an opening between one another and meet at the distal end of the applicator member, the support having an overall tapered shape in the direction of said distal end when viewed in a direction generally perpendicular to the opening, and at least one arched bridge of material that extends along a curved longitudinal axis and transversely to the longitudinal axis of the applicator member and is connected to said arms of the support, protruding from the opening on the opposite side from a recess of the elbow formed by the applicator member and the stem, wherein the applicator member further has at least one straight bridge of material, or said at least one bridge of material is arched, extending along a curved longitudinal axis, the applicator member further having at least one arched bridge of material protruding on the side of the recess of the elbow formed by the applicator member and the stem, the different arched bridges of material extending alternately above and below the opening defined by the support, and wherein at least one bridge of material extends along an oblique axis with respect to the longitudinal axis of the applicator member.

2. The applicator according to claim 1, wherein the applicator member further has at least one straight bridge of material.

3. The applicator according to claim 2, wherein the applicator member further has a plurality of straight bridges of material.

4. The applicator according to claim 1, wherein the applicator member has an alternation of arched bridges of material and straight bridges of material.

5. The applicator according to claim 1, wherein the axis along which a bridge of material extends forms, with the longitudinal axis of the applicator member, an angle of between 10° and 80°.

6. The applicator according to claim 5, wherein the bridges of material extend along mutually parallel axes.

7. The applicator according to claim 5, wherein the angle is between 30° and 60°.

8. The applicator according to claim 1, wherein flocking is present on at least a portion of the surface of at least one bridge of material.

9. The applicator according to claim 8, wherein flocking is present on at least a portion of the surface of each bridge of material.

10. The applicator according to claim 8, wherein flocking is present on the entire surface of each bridge of material.

11. The applicator according to claim 1, wherein flocking is further present on the two opposite arms of the support.

12. The applicator according to claim 11, wherein flocking is further present on the front region of the support at the opposite end from the stem where the two opposite arms of the support meet.

13. The applicator according to claim 1, wherein the bridges of material are devoid of spikes.

14. The applicator according to claim 1, wherein the arms of the support have a variable thickness.

15. The applicator according to claim 14, wherein the thickness decreases towards the distal end of the applicator member.

16. The applicator according to claim 14, wherein the angle is between 5° and 10°.

17. The applicator according to claim 1, wherein the opposite arms of the support extend in a plane comprising the longitudinal axis of the applicator member.

18. The applicator according to claim 1, wherein the longitudinal axis of the applicator member forms, with the longitudinal axis of the stem, an angle of between 2° and 30°.

19. The applicator according to claim 1, wherein the keratin fibres are the eyebrows.

20. A packaging and application device having an applicator as defined in claim 1 and a container containing a composition for making up and/or caring for human keratin fibres, to be applied with the aid of said applicator.

21. A method for making up and/or caring for human keratin fibres, involving the application of a composition, in particular simultaneously to said fibres and to the underlying skin, by means of the applicator of the device as defined in claim 20.

22. The method according to claim 21, being for making up and/or caring for the eyebrows.

23. The device according to claim 20, the composition being for making up and/or caring for the eyebrows and/or hairs of the beard and/or roots of the hair.

24. The applicator according to claim 1, being for applying makeup to and/or caring for the eyebrows and/or hairs of the beard and/or the roots of the hair.

25. The applicator according to claim 1, wherein all the bridges of material extend along an oblique axis with respect to the longitudinal axis of the applicator member.

26. The applicator according to claim 1, wherein a spacing between consecutive bridges of material protruding on a same of side of the support is between 0.8 mm and 1 mm.

* * * * *